US005255746A

United States Patent [19]

Bridges

[11] Patent Number: 5,255,746

[45] Date of Patent: Oct. 26, 1993

[54] ADJUSTABLE MANDREL HANGER ASSEMBLY

[75] Inventor: Charles D. Bridges, Houston, Tex.

[73] Assignee: ABB Vetco Gray Inc., Houston, Tex.

[21] Appl. No.: 927,025

[22] Filed: Aug. 6, 1992

[51] Int. Cl.[5] ..... E21B 43/10

[52] U.S. Cl. ..... 166/348; 166/382; 166/98; 285/145

[58] Field of Search ..... 166/348, 382, 345, 245, 166/85, 120, 208; 285/18, 24, 140, 141

[56] References Cited

U.S. PATENT DOCUMENTS

| | | | |
|---|---|---|---|
| 4,456,070 | 6/1984 | Watkins | 166/345 |
| 4,903,992 | 2/1990 | Jennings et al. | 285/24 |
| 4,909,546 | 3/1990 | Nobileau | 285/18 |
| 4,919,454 | 4/1990 | Caulfield et al. | 285/18 X |
| 4,949,786 | 8/1990 | Eckert et al. | 166/208 |
| 5,002,131 | 3/1991 | Cromar et al. | 166/382 |

*Primary Examiner*—Ramon S. Britts
*Assistant Examiner*—Frank S. Tsay
*Attorney, Agent, or Firm*—James E. Bradley

[57] ABSTRACT

An adjustable mandrel hanger assembly will maintain tension in a section of casing extending from a subsea location to a surface wellhead. The assembly has a mandrel that secures to the upper end of the casing. The mandrel has grooves on its exterior. A collet slides over the mandrel and has grooves on its interior for mating with the grooves on the mandrel. The collet has inclined load flanks on its exterior. A load ring lands on a load shoulder provided in the surface wellhead housing. The load ring has load flanks on its interior that engage the load flanks of the collet. A retaining ring locks the load ring in the wellhead housing. A running tool pushes downward on the load ring while tension is maintained on the mandrel. The collet ratchets over the mandrel grooves.

10 Claims, 4 Drawing Sheets

ADJUSTABLE MANDREL HANGER ASSEMBLY

BACKGROUND OF THE INVENTION

1. Field of the Invention

This invention relates in general to a system for tensioning a section of casing extending between a subsea housing and a surface wellhead located on an offshore platform, and in particular to a system utilizing an adjustable mandrel.

2. Description of the Prior Art

In one type of offshore drilling, particularly with jack-up drilling rigs, a wellhead housing will be located at the platform. The string of casing in the well will be supported by a mudline hanger located in a subsea housing at the sea floor. The sections of casing above the subsea housing need to be tensioned.

U.S. Pat. Nos. 4,909,546 and 5,002,131 show systems for applying tension to the casing above a subsea housing. There have been other systems proposed also that employ a means to pull tension on the casing, a ratcheting means to ratchet during the upward movement of the casing, the ratcheting means then supporting the casing in tension when the upward pull is relaxed. While these systems are workable, improvements are desirable in reducing cost, and in providing greater ease in installation.

SUMMARY OF THE INVENTION

In this invention, an adjustable mandrel hanger assembly is provided for allowing tension to be pulled in the section of casing between the subsea housing and surface wellhead housing. The adjustable mandrel assembly includes a mandrel which has grooves on its exterior. A collet slides over the mandrel and has grooves which will ratchet and mate with the grooves on the mandrel. The collet has load flanks on its exterior. The collet locates in a load ring. The load ring lands on a load shoulder provided in the wellhead housing. A retainer ring will lock the load ring in the wellhead housing.

A running tool will engage the mandrel and push the collet and load ring downward once the desired tension has been applied to the casing. Ratcheting occurs during movement between the collet and the mandrel. When the upward pull on the mandrel is relaxed, the grooves on the mandrel and the collet will transfer a load to the load ring, supporting the section of casing in tension.

DETAILED DESCRIPTION OF THE INVENTION

Figure 1A:
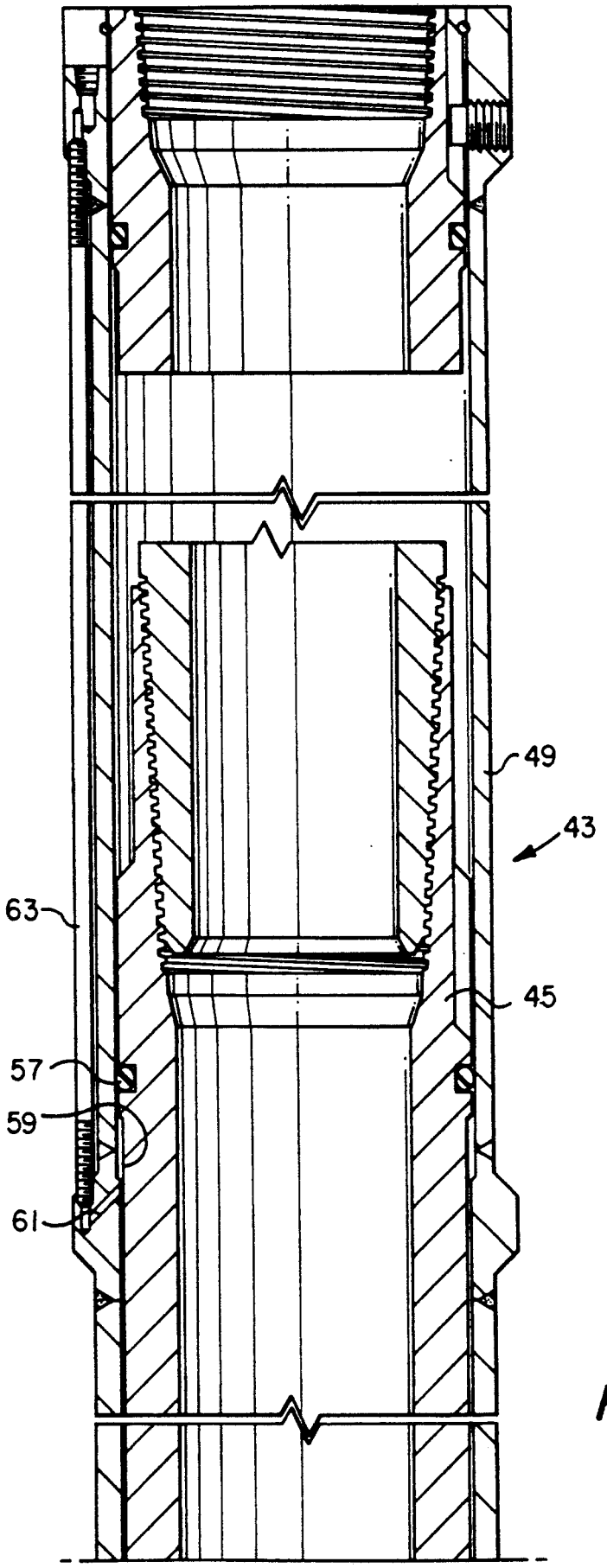
FIGS. 1*a* and 1*b* are a vertical sectional view illustrating an adjustable mandrel hanger assembly, including the running tool, constructed in accordance with this invention.
Figure 1B:
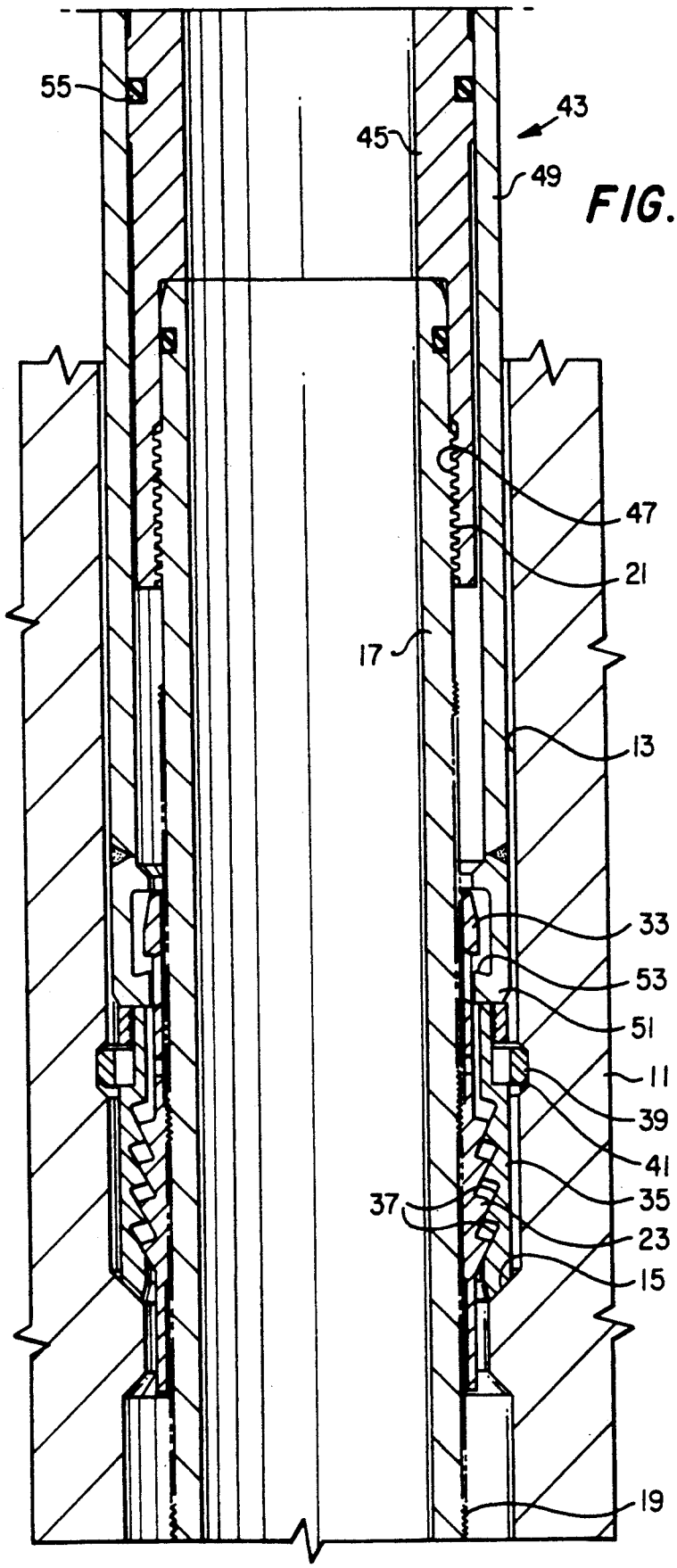

Referring to FIG. 1*b*, wellhead housing 11 will be located at a surface platform, which will normally be supported on legs on the sea floor. Wellhead housing il has an axial bore 13 with an upward facing conical shoulder 15.

Figure 3:
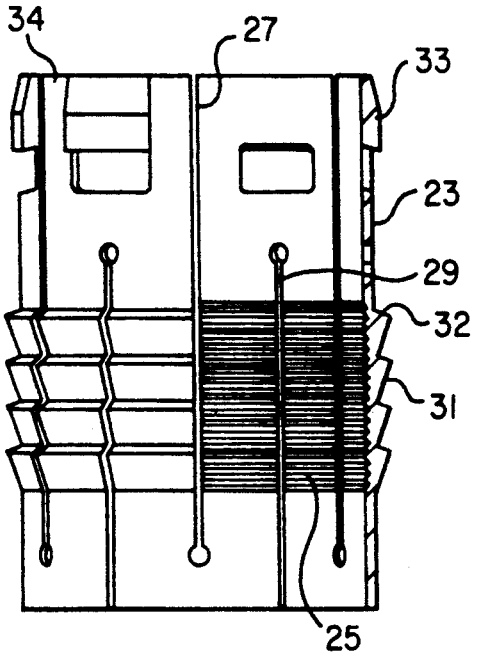
FIG. 3 is an enlarged front elevational view, partially sectioned, of a collet employed with the assembly of FIGS. 1*a* and 1*b*.

A mandrel 17 has a lower end (not shown) that secures to an upper end of a string of casing. The string of casing will extend down to the sea floor and into the well. The string of casing will latch in a mudline hanger (not shown) in a subsea housing in a conventional manner. Mandrel 17 is a tubular member having a plurality of wickers 19 on its exterior. Wickers 19 are small circumferentially extending grooves. Wickers 19 are not threads, rather are located in planes perpendicular to the axis of mandrel 17. Wickers 19 are triangular in configuration, as illustrated in FIG. 3. The upper and lower flanks of each wicker 19 are contained in planes that incline relative to the axis of mandrel 17 at the same angular degree. Mandrel 17 also has a set of threads 21 on its upper end, as shown in FIG. 1*b*.

A collet 23 will slide downward over mandrel 17. Collet 23, as illustrated also in FIG. 3, is a tubular member having a plurality of wickers 25 in its interior. Wickers 25 are identical to wickers 19. Collet 23 has expansion means for allowing it to expand and contract to allow wickers 25 to ratchet over wickers 19 when mandrel 17 moves upward relative to collet 23. The expansion means comprises alternating upper slots 27 and lower slots 29. The upper slots 27 extend downward from the upper edge of collet 23. The lower slots 29 extend upward from the lower edge of collet 23. This results in a generally serpentine configuration to the body of collet 23.

Collet 23 has a plurality of load flanks 31 on its exterior. Load flanks 31 are large circumferential grooves relative to wickers 25. The pitch or distance between each load flank 31 will be many times as great as the pitch between the wickers 25. Each load flank 31 is formed helically, rather than parallel as wickers 25. Each load flank 31 is conical and inclines relative to the axis of mandrel 17 at approximately a 20 degree angle. Each load flank 31 faces downward and outward and is separated from adjacent load flanks 31 by upper flanks 32. Upper flanks 32 face upward and outward and incline relative to the axis of mandrel 17 at an angle of about 10 degrees.

Referring to FIG. 1*b* and FIG. 3, a plurality of fishing neck lugs 33 are located on the upper end of collet 23. Fishing neck lugs 33 are hooks, spaced circumferentially apart from each other, resulting in vertical slots 34 between each lug 33. Lugs 33 enable collet 23 to be released if necessary.

Referring again to FIG. 1*b*, collet 23 locates within a load ring 35. Load ring 35 is a solid ring, having no vertical slots, and being inexpansable. Load ring 35 has a lower end that lands on wellhead housing shoulder 15. Load ring 35 has a plurality of load flanks 37 in its interior. Load flanks 37 mate with load flanks 31. Each load flank 37 faces upward and inward. Load flanks 37 are identical in configuration to load flanks 31. Each load flank 37 is separated from adjacent load flanks 37 by a downward facing lower flank 38. Lower flank 38 is parallel to upper flank 32.

A split retainer ring 39 is carried by load ring 35. Retainer ring 39 serves as means for locking load ring 35 into wellhead housing. Retainer ring 39 is biased outward for snapping into a recess 41 formed in bore 13 above shoulder 15.

Referring to FIGS. 1*a* and 1*b*, a running tool 43 secures to mandrel 17. Running tool 43 has an inner barrel 45 which has threads 47 on its lower end. Threads 47 engage threads 21 on the upper end of mandrel 17.

Running tool 43 has an outer barrel 49 that extends slidingly over inner barrel 45. Outer barrel 49 has a lower end 51 that will bear against the upper end of load ring 35. Lower end 51 has a plurality of hooks 53 separated by vertical slots, each hook 53 extending inward from the lower end 51. The slots (not shown) in the lower end 51 enable the hooks 53 to pass through the slots 34 between the lugs 33 on collet 23. The width of each hook 53 is slightly less than the width of each slot 34, so as to allow the hooks 53 to be pulled upward with outer barrel 49 without engaging lugs 33.

A pair of O-ring seals 55, 57 are located on inner barrel 45. Seals 55, 57 seal against the bore of outer barrel 49. As shown in FIG. 1*a*, a hydraulic chamber 59 is provided between the seals 55, 57. A hydraulic passage 61 leads through outer barrel 49 to communicate hydraulic fluid from a conduit 63 to chamber 59. Supplying hydraulic fluid to chamber 59 will cause outer barrel 49 to move downward relative to inner barrel 45.

In operation, a subsea housing will be located at the sea floor. After the well has been drilled to a selected depth, casing will be lowered into and cemented in the well. The casing in the well will be suspended at a conventional mudline hanger at the subsea wellhead.

Later, the operator will install a tieback casing string from the mudline hanger t the wellhead housing 11 located on a production platform. The tieback string of casing will have a mudline hanger latch for latching into the mudline hanger at the subsea wellhead housing. Mandrel 17 will be secured to the upper end of the string of tieback casing. Collet 23 will be located in load ring 35 and placed on the mandrel 17 at the upper end of mandrel 17. The inner barrel 45 of running tool 43 will be secured to mandrel 17.

To tension the casing, the operator will pull upward by lifting the running tool 43 with a lifting means at the platform, such as drilling rig blocks. Once the desired tension has been reached, the operator will supply hydraulic fluid pressure to chamber 59, while maintaining the upward force on mandrel 17. This causes outer barrel 49 to begin moving downward relative to inner barrel 45, which is held stationary. The lower end 51 of outer barrel 49 pushes down on the load ring 35, causing collet 23 to move downward. As collet 23 moves down over mandrel 17, wickers 25 will ratchet on wickers 19. The load ring 35 lands on shoulder 15 of wellhead housing 11, and retainer ring 39 snaps into recess 41. During the ratcheting movement, the load flanks 31 will slide upward and downward on the load flanks 37.

Figure 2:
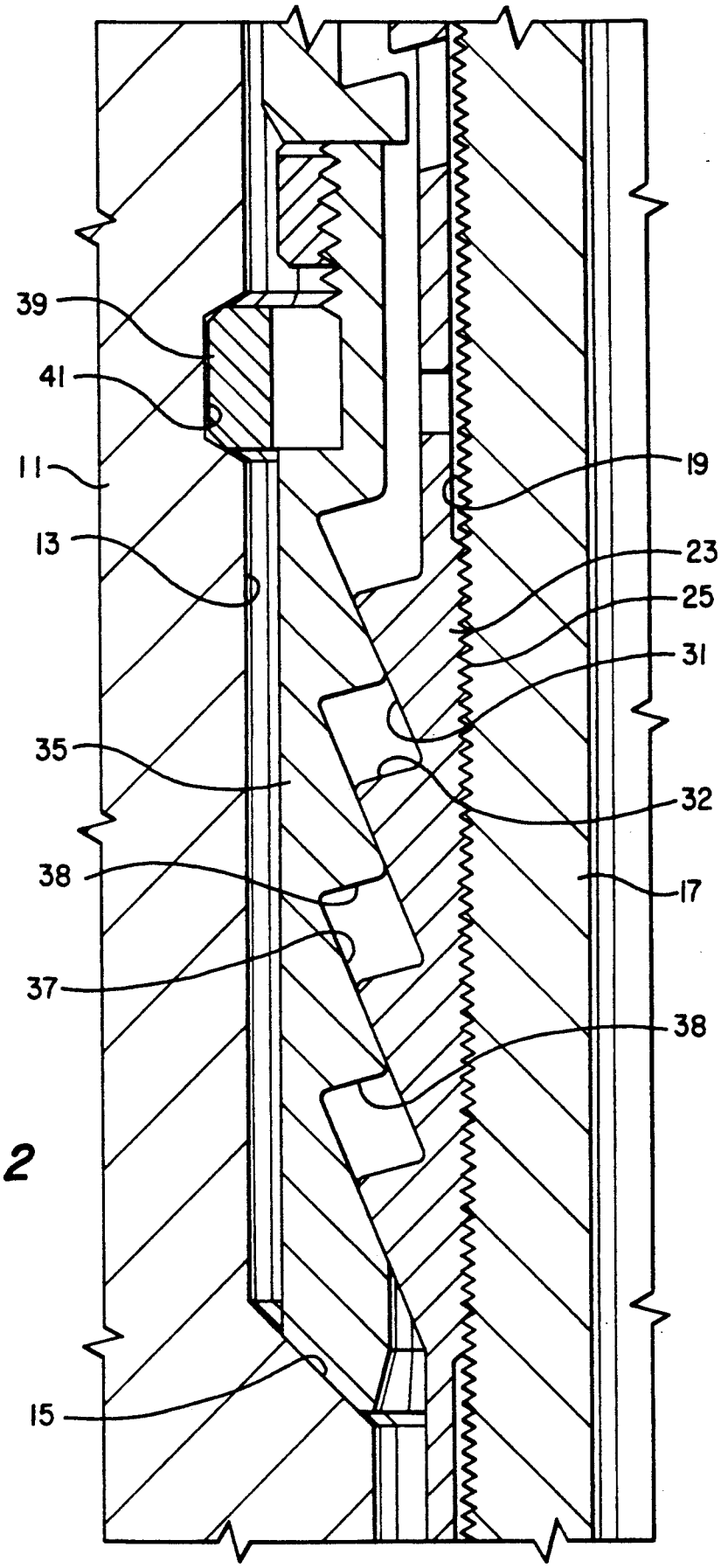
FIG. 2 is a partial quarter sectional view of a portion of the adjustable mandrel hanger assembly of FIG. 1.

After load ring 35 contacts shoulder 15, the tension on the inner barrel 45 may be relaxed and the hydraulic pressure in chamber 59 relieved. Mandrel 17 will be prevented from downward movement by the engagement of wickers 19 and 25. The tension load on mandrel 17 will transmit through the load flanks 31, 37 to the shoulder 15. FIG. 2, which shows the fully engaged position, shows that a significant clearance will exist between the upper flank 32 and the corresponding lower flank 38.

Figure 4:
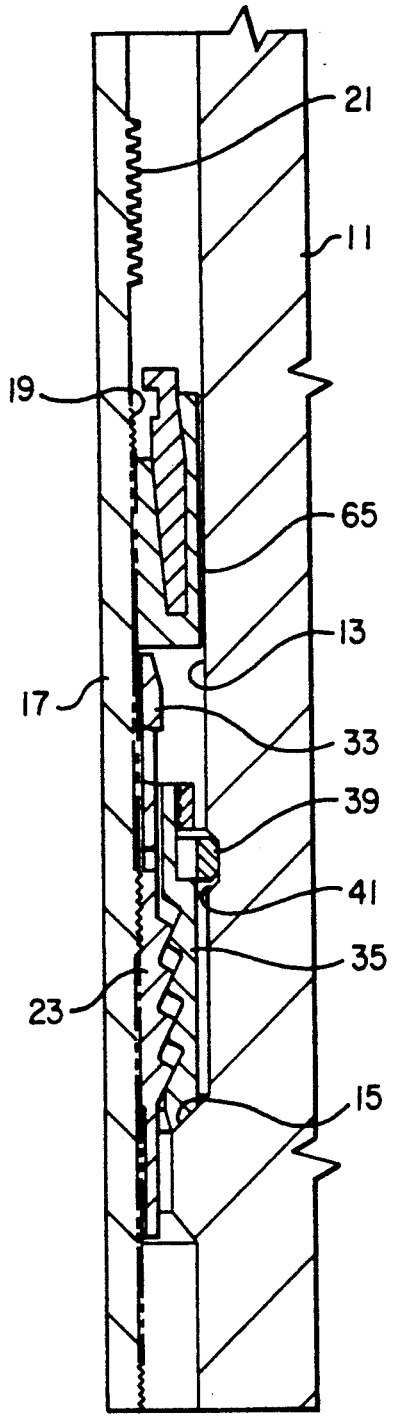
FIG. 4 is a partial quarter sectional view illustrating the mandrel hanger assembly of FIG. 1, and showing the running tool removed and a seal installed.

Then, the operator will pull outer barrel 49 upward to clear the slotted lower end 51 from the lugs 33. The operator will then rotate the inner barrel 45 to unscrew threads 47 from threads 21. The operator removes the running tool 43. Then, as shown in FIG. 4, a conventional seal 65 may be installed on top of collet 23. Seal 65 may be of various types, such as one shown in U.S. Pat. No. 4,665,979, Carl F. Boehm, Jr., issued May 19, 1987. Seal 65 seals against mandrel wickers 19.

Later, if the operator needs to remove the tension from the string of casing, the operator may utilize the running tool 43. Once in position as shown in FIG. 1*b*, and with the seal 65 removed, the operator rotates the outer barrel 49 slightly so that hooks 53 locate below and engage lugs 33. The operator then screws the running tool inner barrel 45 onto the mandrel threads 21. The operator will then pull the running tool inner barrel 45 upward with the drilling rig blocks to a tension sufficient to remove the compressive load passing through the collet 23 and load ring 35 to the shoulder 15.

The operator will then supply hydraulic pressure from a port (not shown) above chamber 59 to cause outer barrel 49 to move upward relative to inner barrel 45. This causes the load ring 35 and collet 23 to move upward from shoulder 15. Collet 23 Will ratchet on the wickers 19 during this upward movement. Once load ring 35 is a sufficient distance above shoulder 15, the operator will slack off the upward force on the inner barrel 45. This slacks off the tieback casing to release its lower end at the mudline hanger at the subsea wellhead. The tieback string may then be removed.

Figure 5:
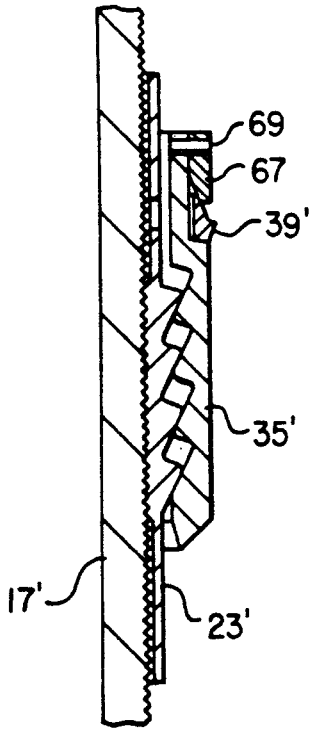
FIG. 5 is a partial quarter sectional view illustrating an alternate embodiment of a portion of the mandrel hanger assembly of FIG. 1.

FIG. 5 illustrates an alternate embodiment, with mandrel 17' and collet 35' being the same as in the first embodiment. The load ring 35' differs in that it employs a different retainer ring 39'. Split retainer ring 39' has a sharp upward facing shoulder for engaging recess 41 (FIG. 4). Recess 41 will be configured with a sharper downward facing shoulder than shown in the first embodiment. Retainer ring 39' snaps into recess 41 when the load ring 35' moves downward adjacent recess 41.

A cam ring 67 locates above the retainer ring 39' and engages a tapered surface on retainer ring 39'. Cam ring 67 is pinned to retainer ring 39' by a shear pin 69. Shear pin 69 does not shear during running of load ring 35', and cam ring 67 remains fixed to retainer ring 39' in a position to avoid interference with the outward movement of retainer ring 39' into recess 41.

To release the retainer ring 39', the lower end 51 of the outer barrel 45 (FIG. 1) strokes downward on the cam ring 67, shearing shear pin 69. Cam ring 67 slides downward on retainer ring 39', causing it to retract from recess 41.

While the invention has been shown in only one of its forms, it should be apparent to those skilled in the art that it is not so limited, but is susceptible to various changes without departing from the scope of the invention.

I claim:

1. An adjustable mandrel hanger assembly for supporting in tension a section of casing extending from a subsea location to a surface wellhead housing, the wellhead housing having an internal load shoulder, comprising in combination:

a mandrel that secures to an upper end of the casing and has grooves on its exterior;

a collet having an inner diameter containing a set of grooves for mating with the grooves on the mandrel, the collet having an exterior containing a plurality of inclined load flanks; and a load ring that lands on the load shoulder provided in the wellhead housing, the load ring having an interior containing a plurality of load flanks that mate with the load flanks of the collet, the collet being radially expansible so as to radially expand and contract to ratchet past the grooves of the mandrel as the load ring is moved downward relative to the mandrel and a pulling force exerted on the mandrel, the load flanks of the collet sliding on but remaining engaged with the load flanks of the load ring during the expansion and contraction of the collet, the load ring and the collet transferring a tension load on the mandrel to the load shoulder when the pull on the mandrel is relaxed.

2. The assembly according to claim 1 wherein the pitch of the grooves is significantly less than the pitch of the load flanks.

3. The assembly according to claim wherein the collet has a plurality of alternating upper and lower slots formed therein, defining a serpentine body.

4. The assembly according to claim 1, further comprising locking means for locking the load ring in the wellhead housing.

5. The assembly according to claim further comprising locking means for locking the load ring in the wellhead housing, the load means comprising a split retainer ring that is biased outward for snapping into a recess provided in the wellhead housing above the load shoulder.

6. The assembly according to claim 1 wherein the load flanks of the load ring incline downward and inward, and wherein the load flanks of the collet incline upward and outward.

7. An adjustable mandrel hanger assembly for supporting in tension a section of casing extending from a subsea location to a surface wellhead housing which has an internal load shoulder, comprising in combination:

a mandrel having a lower end for securing to an upper end of the casing and has grooves on its exterior, the grooves being triangular shaped circumferentially extending wickers;

a collet having an inner diameter containing a set of grooves identical to the grooves on the mandrel for mating with the grooves on the mandrel, the collet having a plurality of alternating upper and lower slots formed therein, defining a serpentine body, the collet having an exterior containing a plurality of conical load flanks, each facing downward and outward;

a load ring configured to land on the load shoulder, the load ring having an interior containing a plurality of conical load flanks that mate with the load flanks of the collet, the load flanks of the load ring facing upward and inward;

a split retainer ring mounted to the load ring and biased outward for engagement with a recess provided in the wellhead housing for locking the load ring in the wellhead housing; and the slots in the collet allowing the collet to radially expand and contract to accommodate ratcheting of the grooves of the mandrel with the grooves of the collet as the load ring is pushed downward relative to the mandrel while tension is applied to the mandrel, the load flanks of the collet sliding on but remaining engaged with the load flanks of the load ring during the expansion and contraction of the collet, the ratcheting of the grooves of the collet and the mandrel and the load flanks of the collet and load ring preventing the mandrel from moving downward relative to the collet to maintain tension in the section of casing.

8. The assembly according to claim 7 further comprising means for pushing the load ring downward relative to the mandrel, comprising:

a threaded section on an upper end of the mandrel;

an inner barrel having a threaded section on a lower end for releasably engaging the threaded section on the mandrel;

an outer barrel which slidingly carries the inner barrel and has a lower end which contacts the upper end of the load ring; and piston means located between the inner and outer barrels, defining a hydraulic chamber, which when supplied with hydraulic fluid under pressure will cause the outer barrel to move downward relative to the inner barrel.

9. A method for supporting in tension a section of casing extending from a subsea location to a surface wellhead housing, comprising the steps of:

providing a mandrel with grooves on its exterior;

providing a collet having an inner diameter containing a set of grooves for mating with the grooves on the mandrel, and an exterior containing a plurality of inclined load flanks;

providing a load ring having an interior containing a plurality of load flanks that mate with the load flanks of the collet;

placing the collet in the load ring and placing the collet and load ring over the mandrel;

securing the mandrel to an upper end of the casing;

applying an upward force to the mandrel until a selected amount of tension is reached; then pushing the load ring and collet downward relative to the mandrel, causing the grooves of the collet to ratchet on the grooves of the mandrel until the load ring lands on a shoulder provided in the wellhead housing; then relaxing the upward force on the mandrel, causing the grooves of the collet to engage the grooves of the mandrel and causing the load due to the tension in the casing to pass through the load flanks of the collet and load ring to the shoulder in the wellhead housing.

10. The method according to claim 9 wherein the step of landing the load ring on a shoulder also includes locking the load ring to the wellhead housing.

* * * * *

UNITED STATES PATENT AND TRADEMARK OFFICE

CERTIFICATE OF CORRECTION

PATENT NO. : 5,255,746

DATED : Oct. 26, 1993

INVENTOR(S) : Charles D. Bridges

It is certified that error appears in the above-identified patent and that said Letters Patent is hereby corrected as shown below:

At column 2, line 6, "il" should be --ll--;

At column 3, line 33, "t" should be --to--;

At column 4, line 23, "Will" should be --will--;

At column 5, line 24, after "claim" insert the numeral --1--;

At column 5, line 26, "load" should be --locking--.

Signed and Sealed this

Sixth Day of September, 1994

Bruce Lehman

*Attest:*

BRUCE LEHMAN

*Attesting Officer*

*Commissioner of Patents and Trademarks*